US005687668A

United States Patent [19]

Kawasaki

[11] Patent Number: 5,687,668

[45] Date of Patent: Nov. 18, 1997

[54] STEERABLE TUG-AND-BARGE LINKAGE

[76] Inventor: Masasuke Kawasaki, 1002 Michigan Ave., Slidell, La. 70458

[21] Appl. No.: 331,351

[22] Filed: Oct. 27, 1994

[51] Int. Cl.[6] ..... B63B 21/62

[52] U.S. Cl. ..... 114/249; 114/250; 114/251

[58] Field of Search ..... 114/246, 248, 114/249, 250, 251

[56] References Cited

U.S. PATENT DOCUMENTS

| | | | |
|---|---|---|---|
| 2,870,734 | 1/1959 | Armstrong et al. | 114/246 |
| 3,125,059 | 3/1964 | Verneaux et al. | 114/246 |
| 3,568,621 | 3/1971 | Kawasaki | 114/235 |
| 3,799,100 | 3/1974 | Marriner | 114/249 |
| 3,882,813 | 5/1975 | Janssen | 114/246 |
| 4,223,628 | 9/1980 | Higuti et al. | 114/249 |
| 4,326,479 | 4/1982 | Kawasaki | 114/235 |
| 4,407,214 | 10/1983 | Kawasaki | 114/235 |
| 5,165,357 | 11/1992 | Kawasaki | 114/248 |

FOREIGN PATENT DOCUMENTS

| | | | |
|---|---|---|---|
| 2 592 358 | 7/1987 | France | B63B 35/70 |
| 12 21 577 | 7/1966 | Germany | B63H 21/62 |
| 12 44 604 | 7/1967 | Germany . | |
| 1961665 | 7/1971 | Germany | 114/250 |
| 0267705 | 5/1989 | Germany | 114/250 |
| 59223595 | 12/1994 | Japan | B63B 35/70 |
| 295871 | 12/1962 | Netherlands | 114/246 |
| 391960 | 1/1974 | U.S.S.R. | 114/249 |

OTHER PUBLICATIONS

International Search Report dated Jan. 29, 1996, EP 95 11 6911.

*Primary Examiner*—Sherman Basinger
*Attorney, Agent, or Firm*—Arnold, White & Durkee

[57] ABSTRACT

An apparatus and method are disclosed for increasing the low speed maneuverability and the stability of sea-going vessels. The apparatus includes a linkage assembly which connects a primary vessel or sub-vessel to a secondary, steering vessel or sub-vessel such that the steering vessel or sub-vessel may yaw with respect to the primary vessel. In preferred embodiments, the linkage assembly includes a pair of linkage arms that are pivotally connected to the primary and secondary vessels, one linkage arm on each side of the secondary vessel. The apparatus may further provide elements to actuate and control the yawing motion of the steering vessel or sub-vessel.

35 Claims, 13 Drawing Sheets

STEERABLE TUG-AND-BARGE LINKAGE

BACKGROUND OF THE INVENTION

1. Field of the Invention

The invention relates to an apparatus for improving the maneuverability and stability of sea-going vessels. In particular, the invention relates to linkages which allow a steering vessel to yaw with respect to a steered vessel, thereby producing a greater steering effect than is possible with conventional steering systems. These linkages may also be used to link two nonsteerable vessels, thereby minimizing destructive lateral bending moments while maintaining stability of the vessels.

2. Description of the Related Art

Traditionally, sea-going vessels have been steered by rudders. A typical rudder is a large, vertical plate aligned with the vessel's longitudinal axis. In most applications, a rudder pivots about a point near its leading edge, thereby producing forces perpendicular to the longitudinal axis of the ship and causing a steering effect. The steering effect of a rudder is based on the surface area of the rudder and the ship's speed. Therefore, at a constant speed the simplest way to increase the steering effect of a rudder-steered vessel is to increase the size of the rudder.

At moderate and high speeds a relatively small rudder is adequate to steer a large sea-going vessel. Difficulty arises, however, in low speed situations, including operations in harbors or other high traffic areas where maneuverability is critical. Because it is impractical or impossible to design and build a large enough rudder to provide adequate maneuverability in low speed situations, most large sea-going vessels must be assisted by tugboats in low speed, high maneuverability situations. Such assistance is frequently required when a large vessel approaches port for mooring.

Several systems have been used on sea-going vessels to attempt to remedy this lack of maneuverability. One approach is to provide a "thruster" near the bow of the ship. A thruster typically consists of an internal propeller whose propulsive force is directed transverse to the ship's longitudinal axis, producing a yawing motion. Similar systems are used on military vessels and are sometimes located at both the bow and stern of a ship. Thrusters are effective at very low speeds, but lose effectiveness rapidly as a ship's speed increases. Therefore, thrusters are usually employed only during the final approach to a pier when the ship is moving at extremely low speeds. Even in these situations thrusters are often inadequate, requiring the use of tugboats to enhance a vessel's maneuverability.

Twin screws are also used to improve low speed maneuverability. In most twin screw vessels, one propeller is located to the port of the ship's center line, and a second to starboard of center line. When the ship is traveling at low speeds, one screw may be reversed in order to produce a twisting effect similar to that produced by the thrusters described above. Although this practice is quite common on multi-screw vessels, it provides only a small improvement in maneuverability. In fact, on large vessels the effect of operating offset screws in opposed directions can be almost imperceptible.

Similar problems are experienced by tugboats which push or pull non-steerable barges. Such tug-and-barge assemblies are common in both intercoastal river navigation and open-ocean shipping. When the tug and barges are moving at a moderate to high speed, the tug's rudder is adequate to steer the barges. However, when the tug and barges slow, the tug's rudder loses much of its steering effect, and additional tugs are needed to adequately steer the assembly.

Harbor tugs frequently are used to solve the problem of poor low-speed maneuverability. Such tugs can be positioned such that the entire submerged surface of the tug will act as a rudder, thereby increasing maneuverability greatly. However, these tugs usually have small rudders and must use lines, capstans, winches, etc. to position themselves with respect to the vessel being steered. Such equipment is costly, cumbersome to use, and requires numerous deck hands to operate.

An apparatus is therefore needed which improves the maneuverability of sea-going vessels at low speeds. Such an apparatus would reduce the need for steering tugs in situations such as harbor approaches in restricted channels, or would allow such tugs to steer large vessels using only the tugs' rudders.

The use of multiple-barge flotillas for open ocean shipping has long been hampered by the lateral bending moment created by yaw forces caused by winds and seas. When such nonsteerable vessels are rigidly connected, or are connected in a way which prevents relative yaw between the vessels, the lateral bending moment can lead to structural failure. Constructing connection materials of sufficient strength to withstand these forces is cost prohibitive. On the other hand, connections which allow two nonsteerable vessels to yaw with respect to each other can be unstable, leading to a "jack-knifing" situation. When this happens, the forces on the connections may be even greater than those acting on rigid connections.

Connecting mechanisms which allow the connected vessels to pitch and heave with respect to each other are in use. Such devices are disclosed in Applicant's U.S. Pat. No. 3,568,621, U.S. Pat. No. 4,326,479, U.S. Pat. No. 4,407,214, and U.S. Pat. No. 5,165,357, which are incorporated by reference. These systems offer advantages over rigid connecting mechanisms, but do not allow the connected vessels to yaw with respect to each other. Therefore, these devices do not reduce the structural stresses caused by the lateral bending moment.

An apparatus for connecting two nonsteerable vessels such that they may yaw without "jack-knifing" is needed. Such a device would reduce the cost of multi-barge flotillas and make such units more viable for open ocean shipping.

SUMMARY OF THE INVENTION

The present invention provides an apparatus for connecting two vessels such that each may yaw with respect to the other. The apparatus includes a linkage assembly and pivoting connection joints which allow relative movement in the yaw plane.

In preferred embodiments, the present invention allows the bow of a steering vessel to move laterally with respect to a steered vessel's stern, enhancing stability and steering effect. When a rudder pivots about its leading edge, the flow of water over the rudder will create a torque which tends to return the rudder to its neutral position, amidships. If the rudder's pivot-point is moved back, this flow torque is offset by a counter-torque created by the portion of the rudder forward of the pivot-point. When the rudder rotates in such an arrangement, water flowing over the portion of the rudder forward of the pivot-point creates a torque in the direction of the rudder's rotation. This torque tends to offset that created by water flowing over the portion of the rudder aft of the pivot-point. If the pivot-point is positioned so that the surface area forward and aft of the pivot-point are equal, the rudder will experience no net torque due to the flow of water over the rudder. This configuration eliminates the need for a continuous force to maintain rudder position and reduces the force required to move the rudder. However, such an arrangement is unstable, with the vessel tending to continue its turn after steering force is removed from the rudder because the rudder does not return to its neutral position until a counter-force acts upon it.

Although it may be undesirable to center the rudder's pivot-point about its steering surface area, there are substantial benefits to locating the pivot-point near this center position. Such positioning reduces greatly the force required to rotate the rudder. The present invention may utilize these principles by allowing the steering vessel's pivot-point to be located aft of that vessel's bow.

In a preferred embodiment, the present invention provides an apparatus which functions to pivotally connect two sub-vessels together. In this embodiment, a sea-going vessel may be built as two separate sub-vessels. For example, a large ocean-going tanker might be built with the tank compartments and the engine compartments as two distinct units. These two "sub-vessels" may be connected through a linkage assembly which allows one sub-vessel to yaw with respect to the other sub-vessel. The present invention provides such a linkage assembly and controls the yawing of the two sub-vessels.

Preferred embodiments of the present invention provide a number of methods to control the rate and range of a steering vessel's rotation with respect to a steered vessel to which it is coupled. First, the two vessels may be connected at the bow of the steering vessel and the stern of the steered vessel such that the steering vessel cannot yaw with respect to the steering vessel. This connection allows normal steering via the steering vessel's rudder at moderate and high speeds, and maintains a streamlined profile which reduces drag. When the ship slows, this connection may be retracted or removed, allowing the steering vessel to yaw with respect to the steered vessel. The rate and range of the steering vessel's yaw may be controlled through a series of hard stops, hydraulic actuators, cables, lines, capstans and other winch assemblies, or any other method which serves to control the rotational velocity or range of the steering vessel.

In a preferred embodiment of the present invention, the apparatus may comprise two linkage arms symmetrically located along each side of the vessels. These linkage arms may be attached to the vessels via a pivoting device at each end of each linkage arm. One end of each linkage arm may be attached to the bow portion of the steering vessel, while the other end of the linkage assembly may be attached to the aft portion of the steered vessel. Propulsive force generated by the steering vessel may be transmitted through these linkage assemblies to the steered vessel.

In an alternative version of this preferred embodiment, the linkage arms may be attached such that the points of connection between the linkage arms and the steering vessel are forward of the points of connection between the linkage arms and the steered vessel. In this embodiment, the propulsive force of the steering vessel would create tension rather than compression in the linkage arms, allowing the use of non-rigid linkage arms, reducing cost and complexity. Mooring lines might be used as linkage arms in this embodiment.

Another preferred embodiment of the present invention consists of a pair of linkage arms connecting a tugboat to a non-steerable barge or group of non-steerable barges. The linkage arms may pivot on a horizontal plane transverse to the direction of the barge's movement. This embodiment might also contain a means for actuating or controlling the tug's yawing. Further, means may be provided for connecting the tug to the barge such that the tug cannot yaw with respect to the barge when the additional steering effect produced by the present invention is unnecessary. Finally, a universal joint may also be provided at each end of the linkage arms to allow freedom of rotation about other axes.

In still another embodiment of the present invention, the linkage assembly is used to connect two nonsteerable vessels together. The present invention controls the positioning and alignment of the linkage assembly so that the vessels may yaw with respect to each other without "jack-knifing." This invention provides an inherently stable connection system which minimizes the lateral bending moment created when relative movement in the yaw plane is constrained.

Accordingly, the present invention overcomes the previously discussed problem of low maneuverability at low speeds. This improvement is accomplished by providing an apparatus which allows a steering vessel to yaw, thereby producing a rudder effect based on the entire surface area of the steering vessel. The steering effect of the present invention is greatly increased by allowing the bow of the steering vessel to move laterally with respect to the steered vessel's stern. This lateral movement results in a stable steering system. The present invention also provides a stable apparatus and method for connecting two nonsteerable vessels together such that they may yaw with respect to each other. These and other advantages of the present invention will be further appreciated from the drawings and the detailed description provided below.

BRIEF DESCRIPTION OF THE DRAWINGS

This invention will be illustrated further by reference to the appended drawings which illustrate exemplary embodiments of the linkage assembly device in accordance with this invention.

STEERABLE TUG-AND-BARGE LINKAGE

BACKGROUND OF THE INVENTION

1. Field of the Invention

Figure 1:
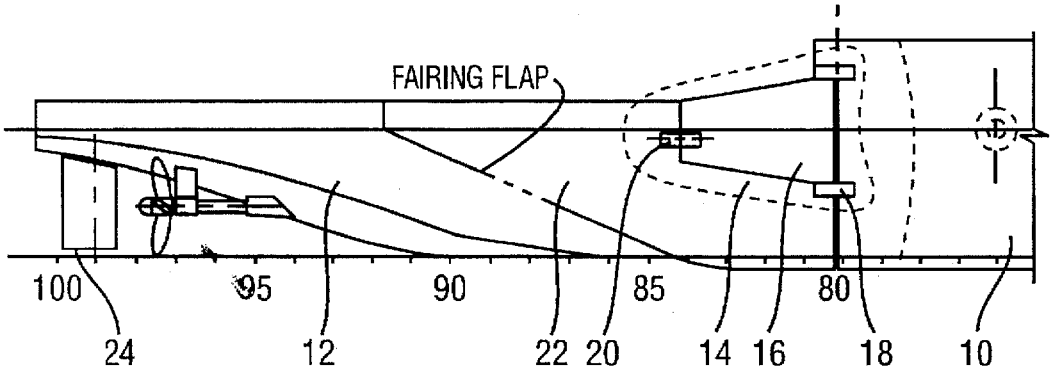
FIG. 1 is a side elevation view of an embodiment of the present invention showing a linkage assembly attached to a steering vessel and a steered vessel.
Figure 2:
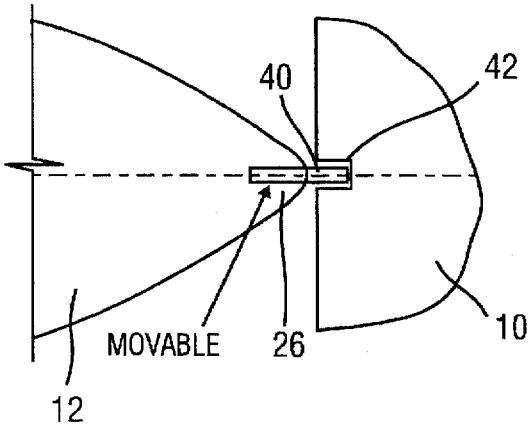
FIG. 2 is a plan view of one method of connecting the bow of the steering vessel to the stern of the steered vessel to prevent yaw.
Figure 3:
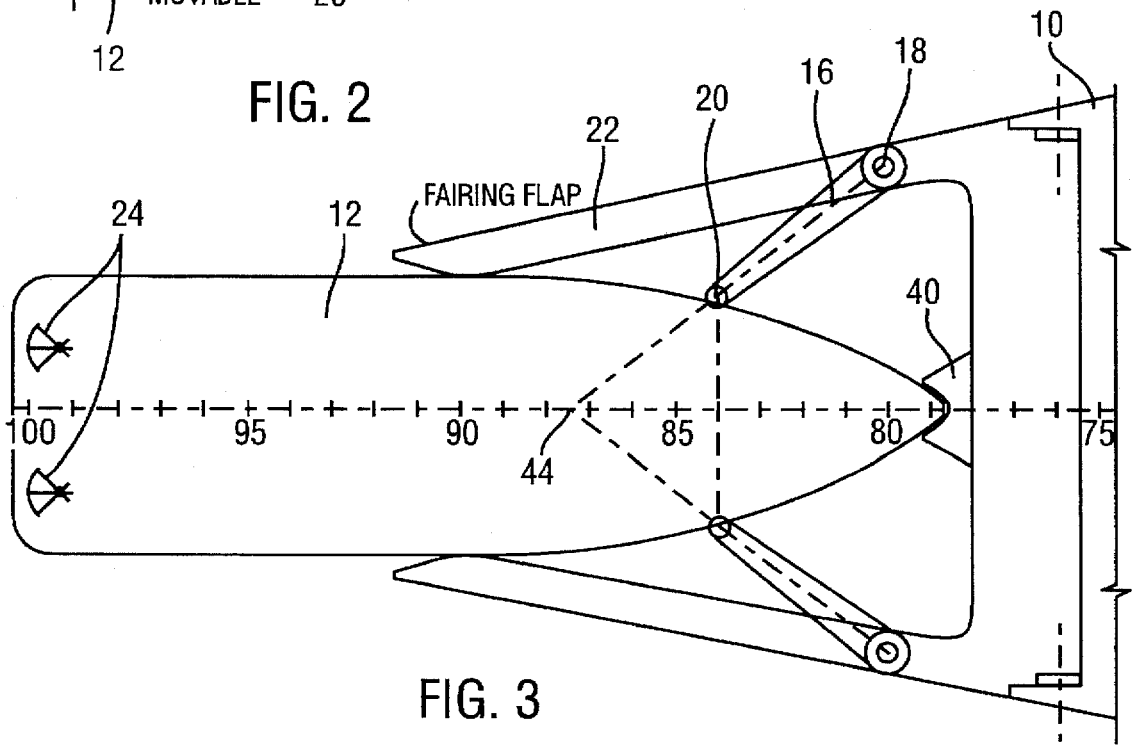
FIG. 3 is a plan view of one embodiment of the present invention, showing the linkage assembly connecting the steered vessel to the steering vessel.

The invention relates to an apparatus for improving the maneuverability and stability of sea-going vessels. In particular, the invention relates to linkages which allow a steering vessel to yaw with respect to a steered vessel, thereby producing a greater steering effect than is possible with conventional steering systems. These linkages may also be used to link two nonsteerable vessels, thereby minimizing destructive lateral bending moments while maintaining stability of the vessels.

2. Description of the Related Art

Traditionally, sea-going vessels have been steered by rudders. A typical rudder is a large, vertical plate aligned with the vessel's longitudinal axis. In most applications, a rudder pivots about a point near its leading edge, thereby producing forces perpendicular to the longitudinal axis of the ship and causing a steering effect. The steering effect of a rudder is based on the surface area of the rudder and the ship's speed. Therefore, at a constant speed the simplest way to increase the steering effect of a rudder-steered vessel is to increase the size of the rudder.

At moderate and high speeds a relatively small rudder is adequate to steer a large sea-going vessel. Difficulty arises, however, in low speed situations, including operations in harbors or other high traffic areas where maneuverability is critical. Because it is impractical or impossible to design and build a large enough rudder to provide adequate maneuverability in low speed situations, most large sea-going vessels must be assisted by tugboats in low speed, high maneuverability situations. Such assistance is frequently required when a large vessel approaches port for mooring.

Several systems have been used on sea-going vessels to attempt to remedy this lack of maneuverability. One approach is to provide a "thruster" near the bow of the ship. A thruster typically consists of an internal propeller whose propulsive force is directed transverse to the ship's longitudinal axis, producing a yawing motion. Similar systems are used on military vessels and are sometimes located at both the bow and stern of a ship. Thrusters are effective at very low speeds, but lose effectiveness rapidly as a ship's speed increases. Therefore, thrusters are usually employed only during the final approach to a pier when the ship is moving at extremely low speeds. Even in these situations thrusters are often inadequate, requiring the use of tugboats to enhance a vessel's maneuverability.

Twin screws are also used to improve low speed maneuverability. In most twin screw vessels, one propeller is located to the port of the ship's center line, and a second to starboard of center line. When the ship is traveling at low speeds, one screw may be reversed in order to produce a twisting effect similar to that produced by the thrusters described above. Although this practice is quite common on multi-screw vessels, it provides only a small improvement in maneuverability. In fact, on large vessels the effect of operating offset screws in opposed directions can be almost imperceptible.

Similar problems are experienced by tugboats which push or pull non-steerable barges. Such tug-and-barge assemblies are common in both intercoastal river navigation and open-ocean shipping. When the tug and barges are moving at a moderate to high speed, the tug's rudder is adequate to steer the barges. However, when the tug and barges slow, the tug's rudder loses much of its steering effect, and additional tugs are needed to adequately steer the assembly.

Harbor tugs frequently are used to solve the problem of poor low-speed maneuverability. Such tugs can be positioned such that the entire submerged surface of the tug will act as a rudder, thereby increasing maneuverability greatly. However, these tugs usually have small rudders and must use lines, capstans, winches, etc. to position themselves with respect to the vessel being steered. Such equipment is costly, cumbersome to use, and requires numerous deck hands to operate.

An apparatus is therefore needed which improves the maneuverability of sea-going vessels at low speeds. Such an apparatus would reduce the need for steering tugs in situations such as harbor approaches in restricted channels, or would allow such tugs to steer large vessels using only the tugs' rudders.

The use of multiple-barge flotillas for open ocean shipping has long been hampered by the lateral bending moment created by yaw forces caused by winds and seas. When such nonsteerable vessels are rigidly connected, or are connected in a way which prevents relative yaw between the vessels, the lateral bending moment can lead to structural failure. Constructing connection materials of sufficient strength to withstand these forces is cost prohibitive. On the other hand, connections which allow two nonsteerable vessels to yaw with respect to each other can be unstable, leading to a "jack-knifing" situation. When this happens, the forces on the connections may be even greater than those acting on rigid connections.

Connecting mechanisms which allow the connected vessels to pitch and heave with respect to each other are in use. Such devices are disclosed in Applicant's U.S. Pat. No. 3,568,621, U.S. Pat. No. 4,326,479, U.S. Pat. No. 4,407,214, and U.S. Pat. No. 5,165,357, which are incorporated by reference. These systems offer advantages over rigid connecting mechanisms, but do not allow the connected vessels to yaw with respect to each other. Therefore, these devices do not reduce the structural stresses caused by the lateral bending moment.

An apparatus for connecting two nonsteerable vessels such that they may yaw without "jack-knifing" is needed. Such a device would reduce the cost of multi-barge flotillas and make such units more viable for open ocean shipping.

SUMMARY OF THE INVENTION

The present invention provides an apparatus for connecting two vessels such that each may yaw with respect to the other. The apparatus includes a linkage assembly and pivoting connection joints which allow relative movement in the yaw plane.

In preferred embodiments, the present invention allows the bow of a steering vessel to move laterally with respect to a steered vessel's stern, enhancing stability and steering effect. When a rudder pivots about its leading edge, the flow of water over the rudder will create a torque which tends to return the rudder to its neutral position, amidships. If the rudder's pivot-point is moved back, this flow torque is offset by a counter-torque created by the portion of the rudder forward of the pivot-point. When the rudder rotates in such an arrangement, water flowing over the portion of the rudder forward of the pivot-point creates a torque in the direction of the rudder's rotation. This torque tends to offset that created by water flowing over the portion of the rudder aft of the pivot-point. If the pivot-point is positioned so that the surface area forward and aft of the pivot-point are equal, the vessel. In this embodiment, mooring lines 60 and winches or capstans 62 may be used to move the bow of the steering vessel 12 laterally with respect to the stern of the steered vessel 10. Such movement, when combined with the linkage assemblies 14 according to this invention, causes the steering vessel 12 to yaw with respect to the steered vessel 10, thus producing the desired steering effect. To produce the starboard yaw shown in FIG. 5, the starboard mooring line 61 is taken in while the port mooring line 63 is let out. By using winches or capstans 62 to control the mooring lines 60, a rapid and stable steering effect can be produced.

Figure 5:
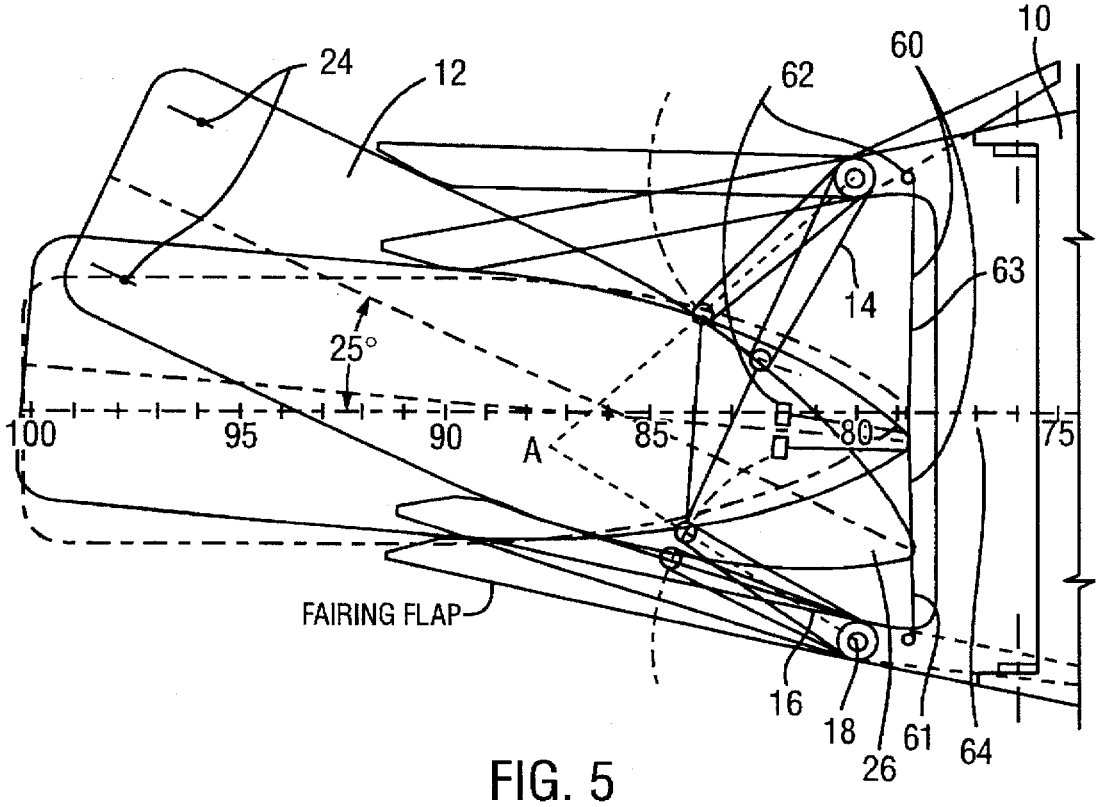
FIG. 5 is a plan view of an embodiment of the present invention using a rigid linkage arm and mooring lines to actuate or control a steering mechanism according to the present invention.

The embodiment illustrated in FIG. 5 could also operate without the external actuating means. The steering vessel's rudder 24 could be used to cause the desired yaw of the steering vessel 12. When the steering vessel 12 turns, the linkage arm 16 will be caused to rotate about the steered vessel pivot joint 18. As illustrated in FIG. 5 this causes the bow of the steering vessel 26 to move laterally relative to the stern of the steered vessel 64.

Figure 6:
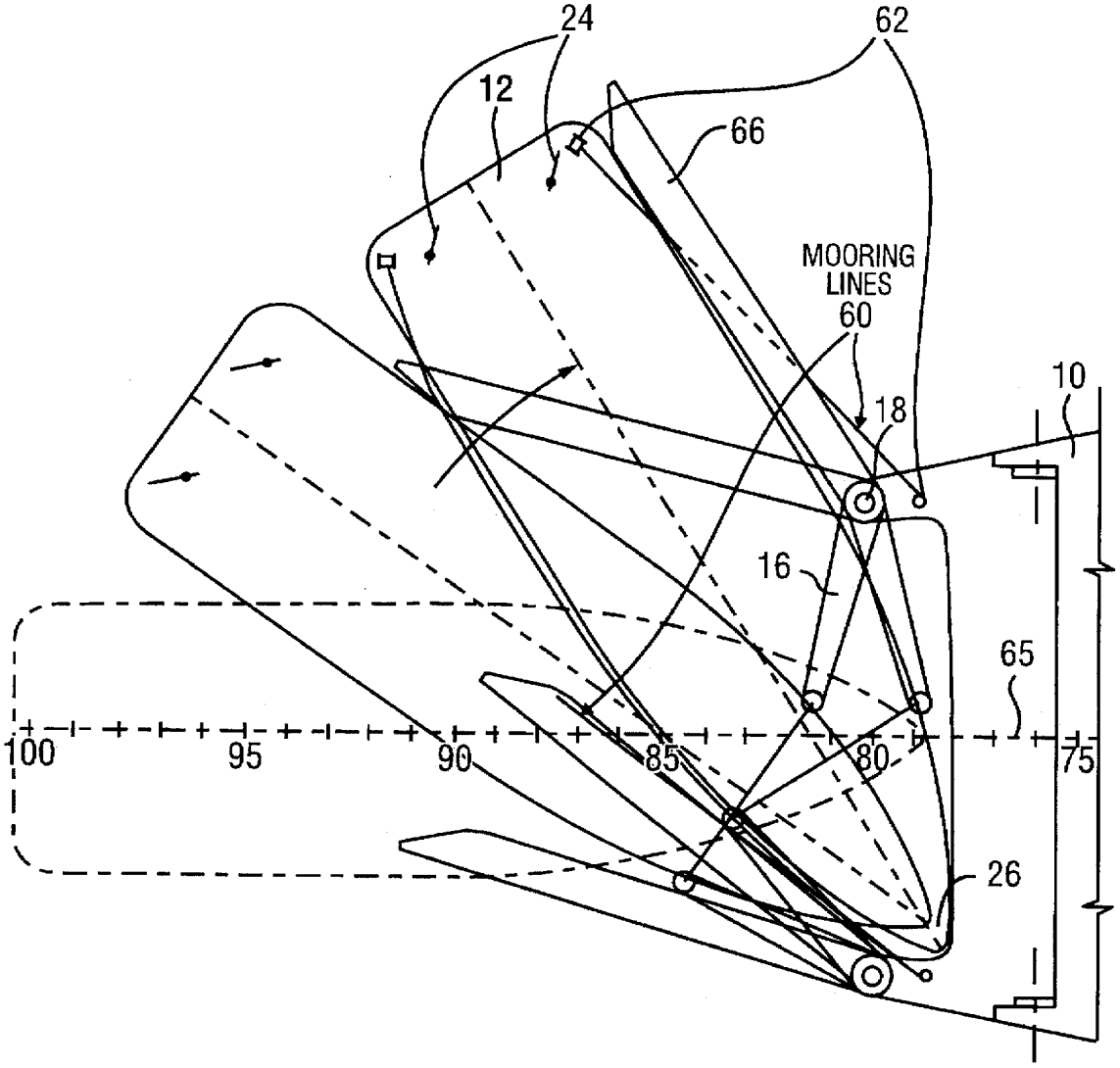
FIG. 6 is a plan view of the embodiment illustrated in FIG. 3 showing the range of travel permitted by the present invention.

FIG. 6 illustrates the wide range of travel permitted the steering vessel 12 under an embodiment of the present invention. FIG. 6 illustrates a similar embodiment to that shown in FIG. 5, which uses either the steering vessel's rudders 24 or mooring lines 60 to control the steering vessel's yaw. In this embodiment, mooring lines 60 extend to winches or capstans 62 at the stern of the steering vessel 12. It is also possible that the mooring lines could simply be used to limit the range of motion or the speed of rotation, with the steering vessel's rudders 24 producing the primary rotational force. Other forms of travel-limiting mechanisms may be implemented to control the range of rotation of the linkage arm 16 about the steered vessel pivot joint 18, or to limit the steering vessel's yaw with respect to the steered vessel 10. Further, the shape of the aft portion of the steered vessel may be used to control the extent to which the steering vessel yaws. This can be seen by comparing the embodiment shown in FIG. 4 with that of FIGS. 5 and FIG. 6. FIG. 5 and FIG. 6 illustrate a steered vessel aft design which allows a wide range of rotation of a steering vessel. Such an embodiment permits a greater steering effect than that shown in FIG. 4, because the steering vessel's bow 26 can travel farther off the longitudinal centerline of the steered vessel 65.

The employment of pivoting fairing flaps 66 is also illustrated in FIG. 6. In the embodiment shown, the aft portion of each fairing flap may be hinged or otherwise pivotally connected to the forward, non-pivoting portion of each fairing flap. This pivoting connection may be the steered vessel pivot joint 18, as shown in FIG. 6. In other embodiments (e.g., the embodiment illustrated in FIG. 4) the pivoting portion of the fairing flaps may also serve as the linkage arm 16. FIG. 6 indicates that a pivoting fairing flap 66 may be employed when a separate linkage arm 16 is used.

FIG. 7, FIG. 8, FIG. 9 and FIG. 10 illustrate four different embodiments of the present invention. A review of these embodiments illustrates the operation and stability of various embodiments of the present invention. Each FIG. shows a different geometry of connection between the steering vessel 12 and the linkage arms 16. The steering ability produced by the present invention is measured by the torque exerted around the combined center of gravity of the steered vessel and steering vessel 70. That torque is calculated as follows:

$$S=Ac+Rr$$

where,

S is torque;

A is propulsion thrust 72;

c is leverage 74 from the center of gravity 70 to the propulsion thrust 72;

R is the transverse component of force on the rudder 76; and r is the distance 78 from vessel's center of gravity 70 to the rudders 24.

Leverage 74 is calculated as follows:

$$c=r\tan(a)$$

where, r is the distance 78; and a is the angle 80 of rotation of the steering vessel about the steered vessel's center line.

The transverse component of the propulsion force from the rudders 76 on an ordinary tugboat is approximately 25% of the total propulsion thrust 72. This value may be as high as 40% on certain tugboat designs. Using the 25% value, we see that:

$$R=0.25A.$$

Therefore, if the angle of rotation 80 is 25°, the torque is calculated as follows:

$$S=Ar\tan 25°+(0.25A)r=0.72Ar.$$

Similarly, if the angle of rotation 80 is 5°, the torque is calculated as follows:

$$S=Ar\tan 5°+(0.25A)r=0.34Ar.$$

Therefore, we can see that increasing the angle of rotation 80 by 20° results in approximately twice the steering effect. Therefore, an embodiment that produces a larger angle of rotation 80 will produce greater maneuverability.

Figure 10:
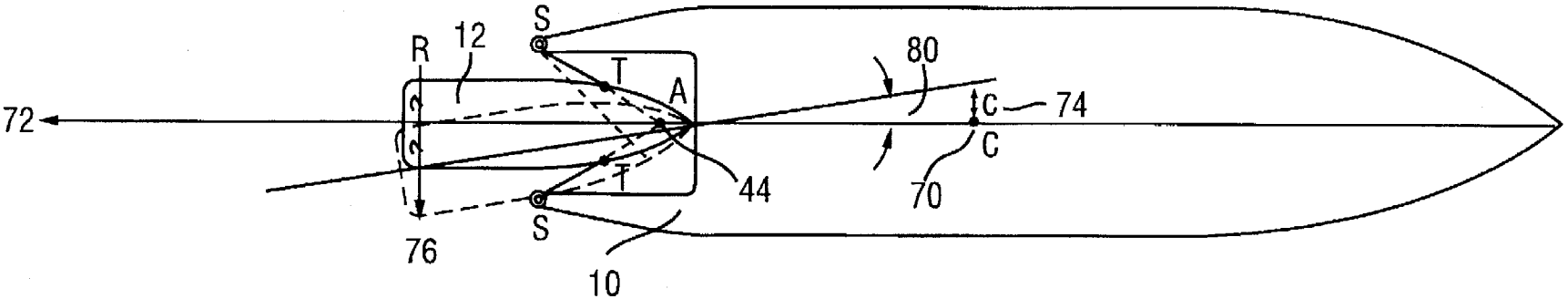

The steering vessel's pivot point 44 is the point of intersection of lines extended along the axis of each linkage arm 16. When the steering vessel 12 is in line with the steered vessel 10 (yaw angle=0°), the location of the pivot point can be changed by relocating the steering vessel pivot joint 20. Proper positioning of the pivot point 44 results in a stable steering system that requires minimal steering force for actuation. When the steering vessel 12 yaws, hydrodynamic forces create torques in both directions about the pivot point Water flowing over the steering vessel surface area forward of the pivot point 44 will generate a torque in the direction the steering vessel 12 is turning. Conversely, water flowing over the steering vessel surface area aft of the pivot point 44 will generate a torque opposed to the steering vessel's rotation. Proper positioning of the pivot point 44 results in a balancing of these torques. Such positioning may be accomplished by moving the steering vessel pivot joint 20, as seen in FIG. 7 and FIG. 10.

Figure 9:
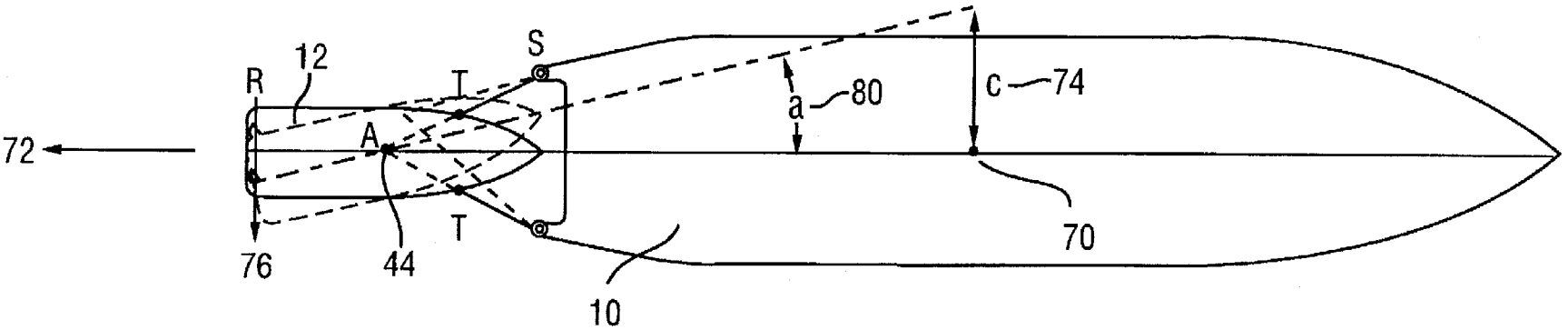

When the linkage assembly is positioned as shown in FIG. 9, the pivot-point 44 is located at the center of the steering vessel 12. In this configuration, the pivot point 44 moves along an arc as the steering vessel 12 yaws, due to the pivoting of the linkage arms 16. When the zero yaw angle pivot point is positioned to produce balanced and offsetting flow torques as shown in FIG. 9, any yaw by the steering vessel with respect to the steered vessel 10 will move the pivot point 44 forward. Such movement results in a net flow torque opposed to the torque created by the steering vessel's rudders 24 (or other steering vessel yaw actuating means), because there will be less steering vessel surface area forward of the pivot point 44 than aft of that point. Therefore, as the steering vessel yaws, more steering force is needed to produce additional yaw. This effect is inherent in the present invention, and results in a safe, stable steering system.

In a typical tugboat and barge arrangement, the barge turns in the opposite direction from the tugboat because the tugboat pushes the stern of the barge in one direction causing the bow of the barge to turn in the opposite direction. Under such an arrangement, using a left rudder on the tugboat will cause the tugboat to turn to port, which will move the stern of the barge to port. Such movement will force the bow of the barge to turn to starboard. This result occurs in a standard pushing situation.

Figure 7:
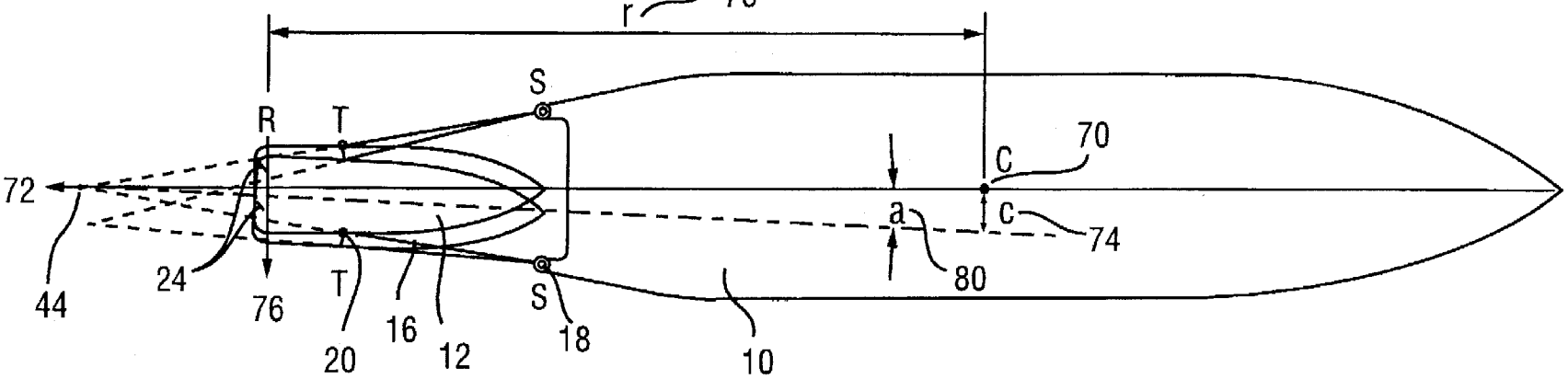
FIG. 7, FIG. 8, FIG. 9 and FIG. 10 are plan views of four different embodiments of the present invention, each involving a different geometry of attachment of the linkage arms to the steering vessel.

In the embodiment of the present invention illustrated in FIG. 7, the opposite occurs: a left rudder angle by the steering vessel 12 turns the steered vessel 10 to port. In the embodiment shown in FIG. 7, the starboard force produced by the tugboat's left rudder causes the tug to rotate clockwise about the pivot-point 44. Clockwise rotation turns the tugboat to starboard, forcing the steered vessel 10 to turn to port. In this embodiment, the steering vessel's response may appear "backwards" to the steering vessel operator. However, if the tug and barge are viewed as a single unit, the configuration shown in FIG. 7 produces the desired response. A ship captain or pilot is accustomed to a left rudder causing a turn to port and a right rudder causing a turn to starboard. The arrangement shown in FIG. 7 allows the captain or pilot to rely on his experience and instinct, an advantage that could be crucial in an emergency. For this reason, the embodiment shown in FIG. 7 is generally preferred to that shown in FIG. 9 and described below.

Figure 8:
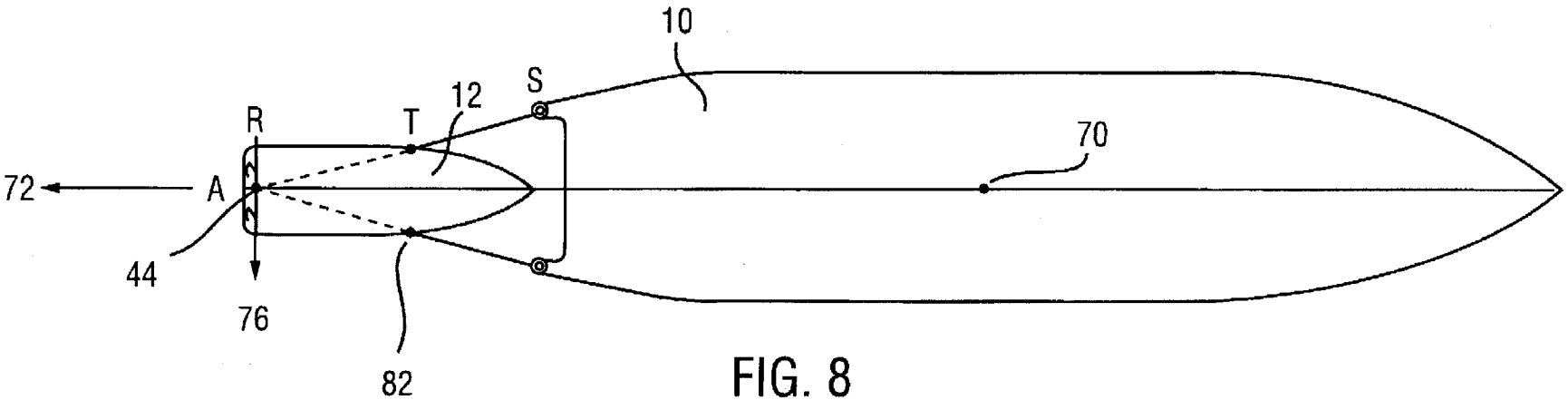

FIG. 8 shows that by locating the pivot point 44 along the line of the transverse thrust from the steering vessel's rudders 76, no rotation of the steering vessel due to that vessel's rudders is produced. By putting the steering vesset's rudders 24 over to port as shown in FIG. 8, no rotational force is developed because the steering vessel's pivot point 44 is located along the same line as that vessel's rudders. In the embodiment illustrated in FIG. 8, some external actuating means is necessary to cause rotation of the steering vessel 12.

In FIG. 9, the pivot point 44 is forward of the transverse thrust of the rudders, 76. Therefore, putting the steering vessel's rudders 24 to port turns the bow of the steering vessel 12 to port, as an operator would expect. When this occurs the entire length of the steering vessel 12 acts as a rudder moving the stern of the steered vessel to port and turning the bow of the steered vessel to starboard. In this embodiment, the tugboat's response is as expected by the operator, but the steered vessel (e.g., a barge) turns in the direction opposite that of the tugboat's rudders. Although a traditional pushing tug and barge arrangement also produces this steering response, it is not as desirable as the response produced in FIG. 7. It is considered preferable for the tug and barge, as a single unit, to respond in the expected way. The captain or pilot in FIG. 9 may rely on his instinct to his own peril.

To prevent the counter-intuitive response of the embodiment shown in FIG. 9, internal controls and displays on the tug can be employed. Such controls would operate to reverse the effect described above, thus reconciling the captain's instinct with actual operation. The actual position of the tug's rudders cannot be seen by the captain, forcing him to rely on displays. Such displays and controls allow the tug to be positioned for instinctive steering of the tug-and-barge combination.

FIG. 8 and FIG. 9, taken together, show an alternative embodiment for accommodating operation at a variety of speeds. As previously discussed, a vessel's rudders normally provide adequate steering effect at moderate and high speeds. Positioning the pivot point 44 along the line of the transverse thrust of the rudders 76 would result in no yawing of the steering vessel 12 due to use of that vessel's rudders 24, as seen in FIG. 8. During low speed operations, a configuration similar to that illustrated in FIG. 9 may be used to enhance maneuverability. By employing a movable steering vessel pivot joint mounting mechanism 82, the present invention may allow for shifting from the embodiment of FIG. 8 to that of FIG. 9, thereby accommodating both high and low speed operations. At high speeds, the mechanism 82 may be positioned so that the pivot-point 44 is located along the line of the rudders' transverse force 76, as shown in FIG. 8. When the vessels slow, the mechanism 82 would be moved forward to produce the invention's yawing effect, as shown in FIG. 9.

FIG. 10 illustrates an embodiment in which the steering vessel pivot joints 20 are located forward of the steered vessel pivot joints 18. In this embodiment the steering vessel 12 pulls the steered vessel 10. Further, in this embodiment the pivot point 44 is located farther from the transverse thrust of the steering vessel's rudders 76 than in the preceding figures. Such an arrangement requires more power to maintain a constant steering vessel yaw because the net flow torque will Oppose such yaw. Also, the shape required for the steered vessel 10 in such an embodiment will pose a limitation on the steering vessel's rotation, and thereby limit the steering effect of the embodiment.

Figure 15:
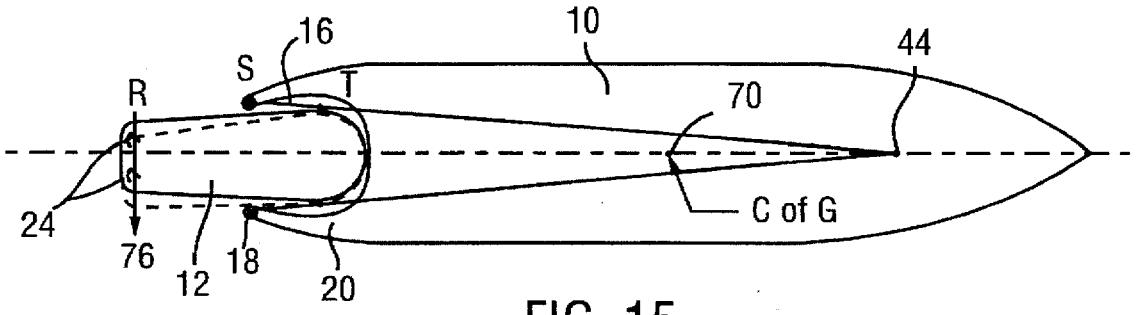
Figure 23:
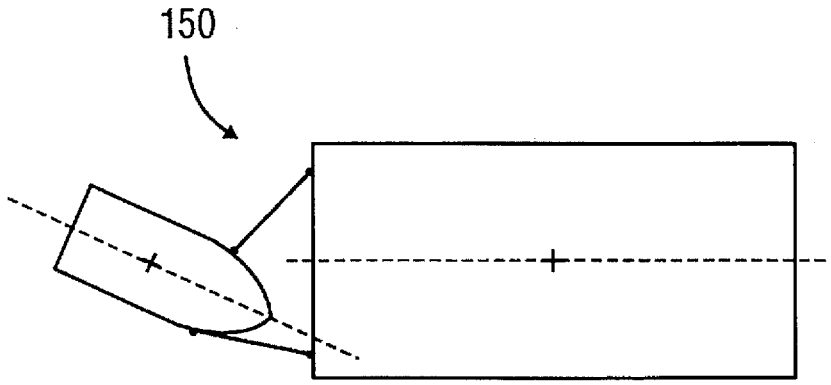

FIGS. 7–10 also show that the present invention allows the connected vessels to move laterally with respect to each other. For example, in FIGS. 7 and 10, the steering vessel 12 moves laterally (i.e., in the yaw plane) with respect to the steered vessel 10. Such movement further reduces the lateral bending moment created by side forces caused by environmental (rough seas) or other sources (traffic). Lateral movement is also illustrated in FIGS. 15 and 23, below.

Figure 4:
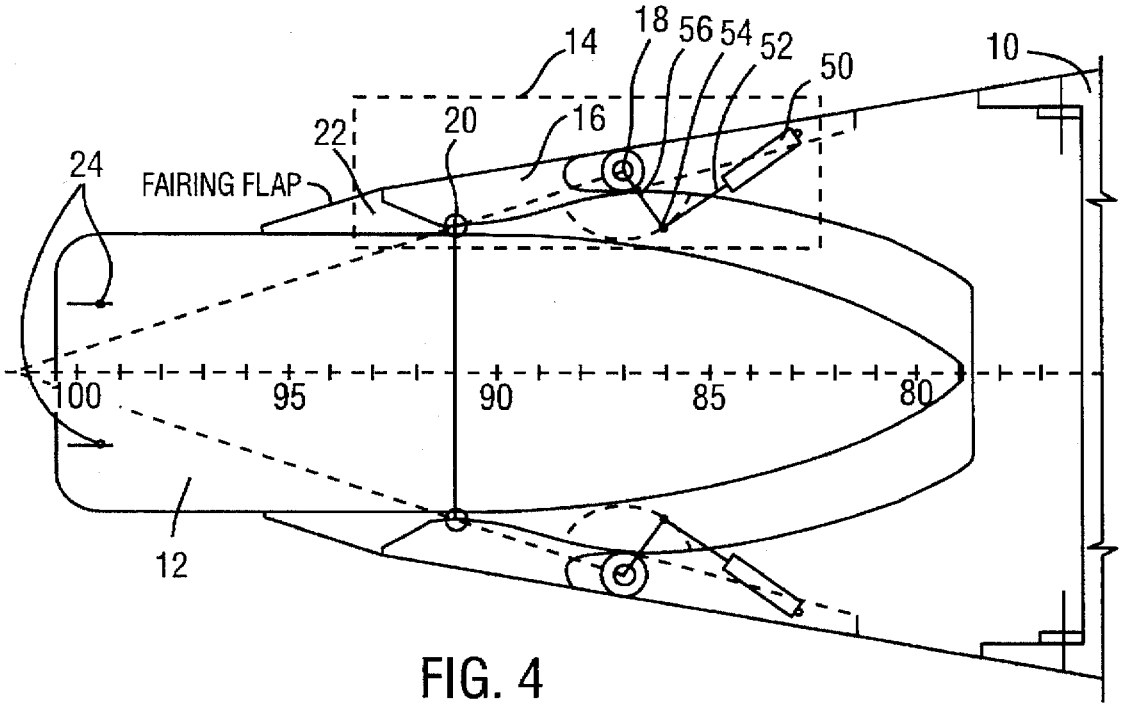
FIG. 4 is a plan view of one embodiment of the present invention showing an hydraulic cylinder employed to actuate the steering mechanism of the invention.
Figure 11:
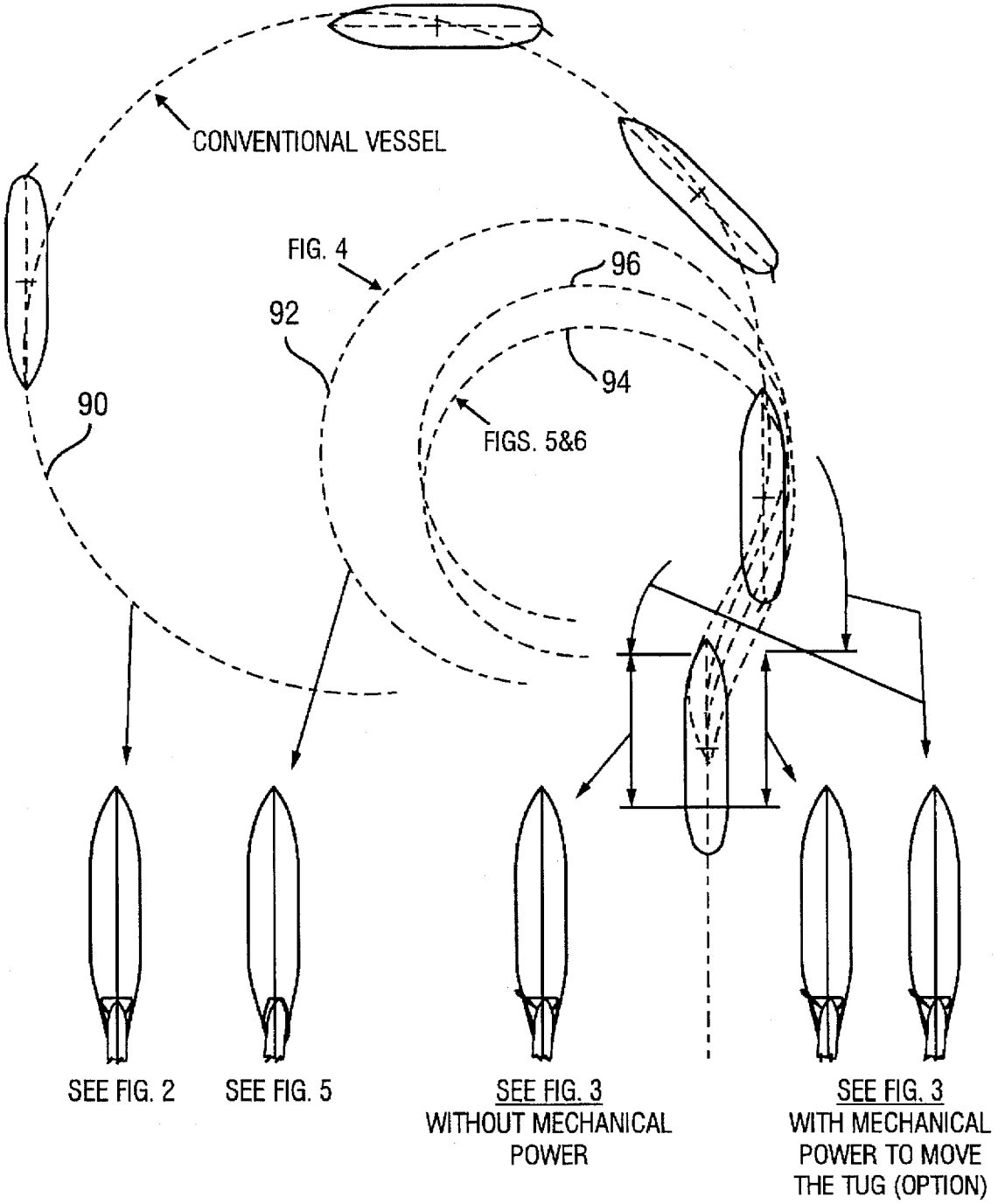
FIG. 11 is an illustration showing the improved maneuverability produced by the present invention.

FIG. 11 demonstrates the relative improvement in maneuverability produced by the present invention. The outermost circular path 90 is a typical turning pattern for a conventional sea-going vessel. The next smaller circular path 92 represents the improved maneuverability of the present invention, with an embodiment utilizing a relatively small yaw angle, perhaps as shown in FIG. 4. The turning path 94 illustrates the relative performance of a vessel using the present invention with a large yaw angle and an external actuating means, perhaps as shown in FIG. 5 and 6. The path shown as 96 is that for a vessel using the present invention with the same yaw angle as the vessel on path 94, but without an external actuating means. The radius of paths 94 and 96 are identical, but in 94 the turn is initiated more quickly by the external actuating means. Therefore, the use of an external actuating means reduces the vessel's motion along its previous path of movement during a turn ("advance"). Excessive advance is an undesirable characteristic, and can be minimized by the use of the present invention.

Figure 12:
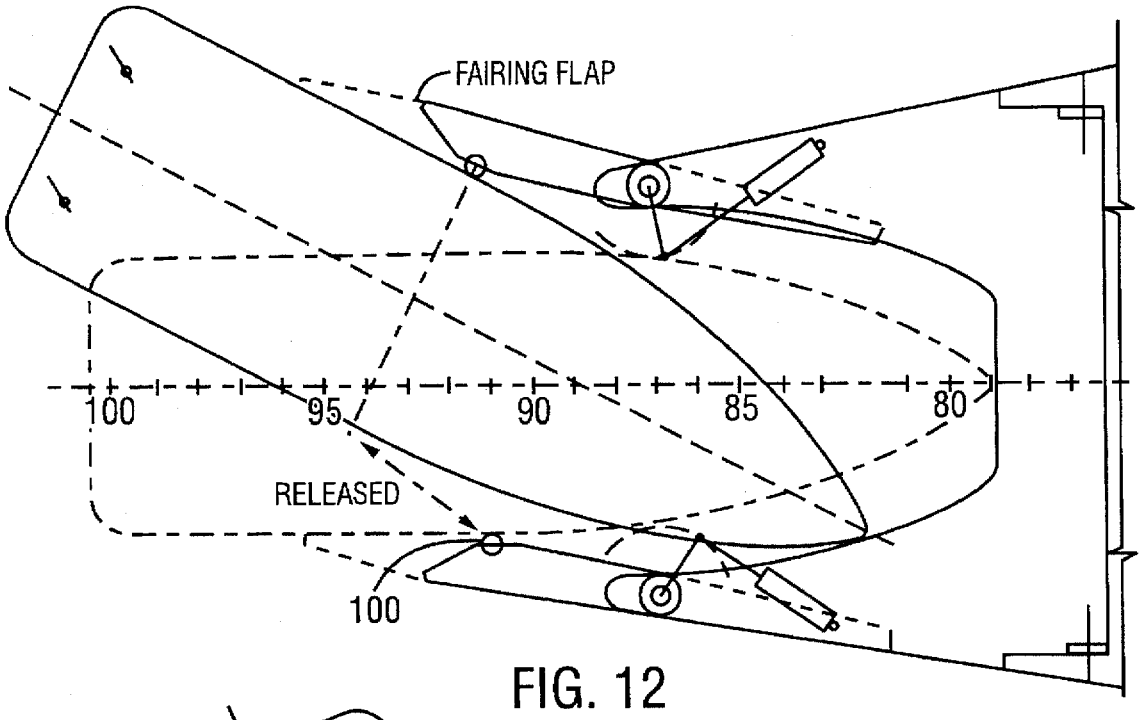
FIG. 12 is a plan view of an embodiment of the present invention showing a releasable connection between the linkage arms and the steering vessel.
Figure 13:
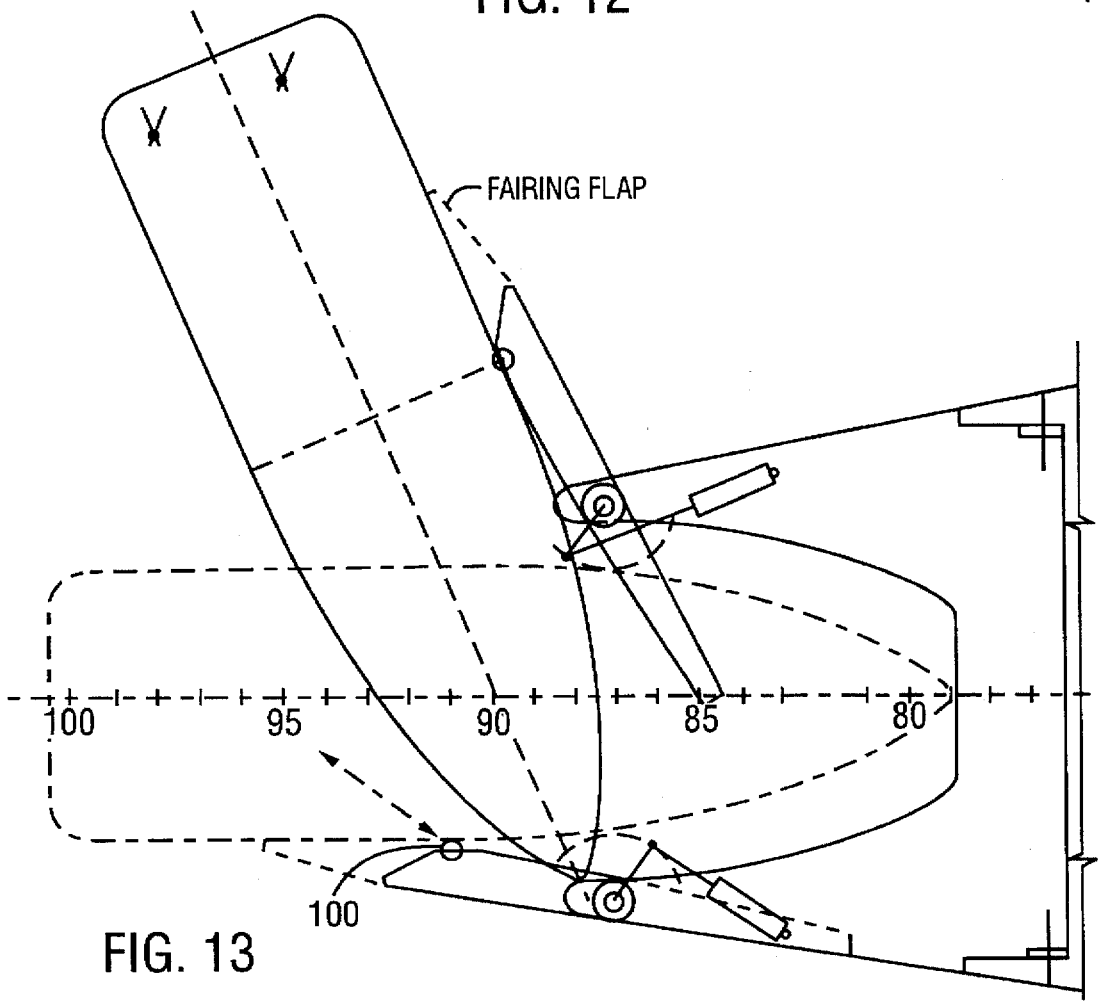

FIG. 12 shows an embodiment of the present invention using a releasable steering vessel pivot joint 100. The advantage of using a releasable pivot joint 100 is illustrated in FIG. 13, which shows the greatly increased steering vessel yaw possible with such an embodiment. This embodiment may require a higher capacity control mechanism, but offers a substantially increased steering effect.

Figure 14:
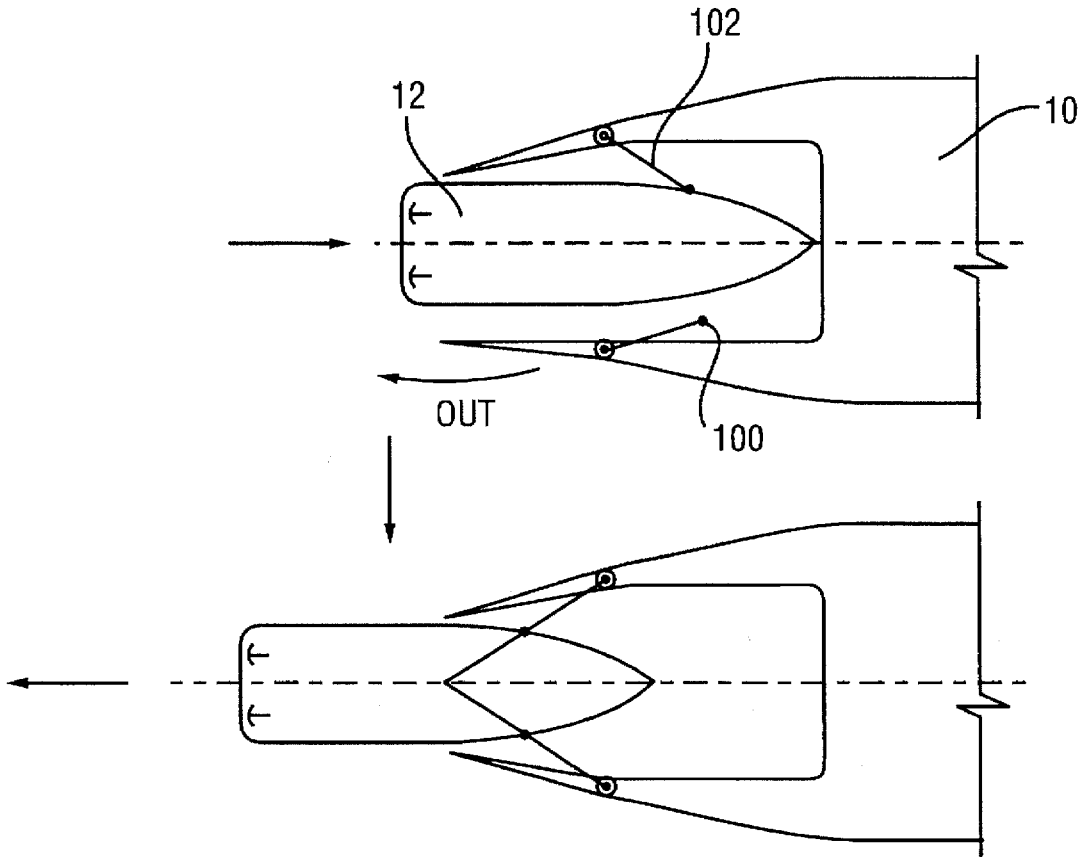

FIG. 14 illustrates an embodiment of the present invention which may utilize a non-rigid linkage arm 102. In this embodiment the steering vessel 12 pulls the steered vessel 10 (upper drawing). Because the linkage arms in such an embodiment are under tension rather than compression, the arms need not be rigid members. The embodiment shown in FIG. 14 might also utilize a releasable steering vessel pivot joint 100 which allows the steering vessel 12 to reverse direction, and then reattach the non-rigid linkage arm 102, so that the steered vessel 10 may be operated in the astern direction (lower drawing). This embodiment offers a potential reduction in cost and complexity, by allowing the use of low-cost, simple, non-rigid linkage arms 102. By way of example, a ship's lines may be used as linkage arms in this embodiment, with a loop of line around a cleat or other device serving as a pivot joint.

FIG. 15 demonstrates that the pivot-point 44 may be located forward of the steered vessel's center of gravity 70. This is accomplished by positioning the linkage assembly 14 such that the lines extended along the axes of the linkage arms 16 intersect forward of the center of gravity 70. When so configured, the tug and barge assembly is stable, but difficult to steer. This result is best explained by referring to FIG. 16.

Figure 16:
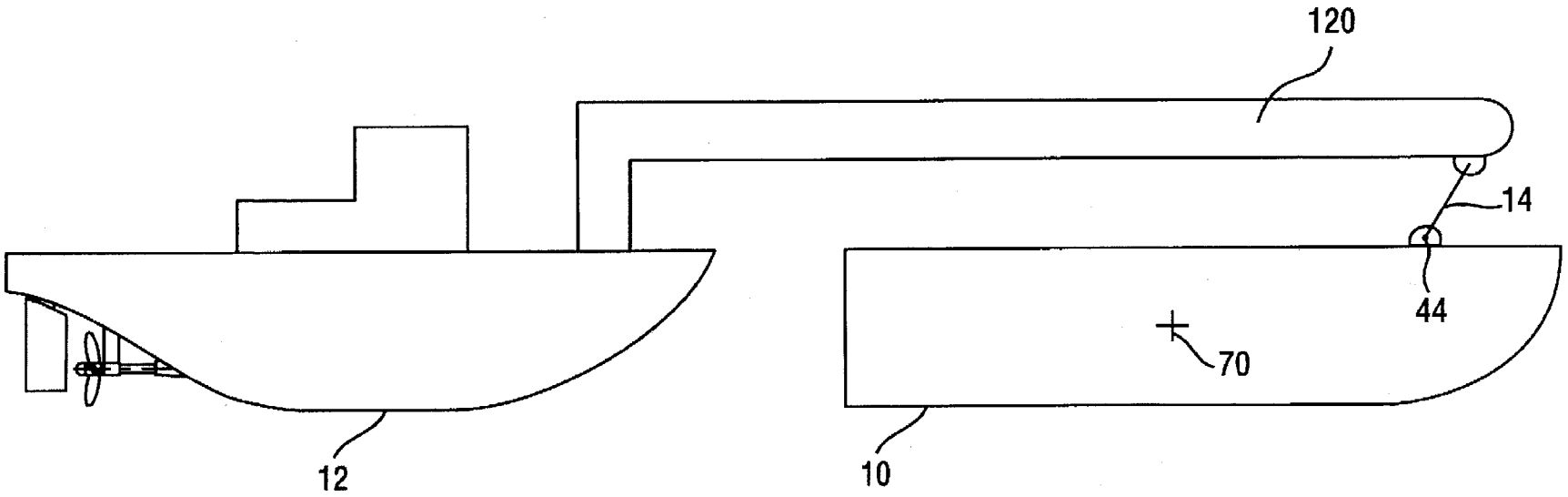

The conceptual drawing in FIG. 16 illustrates one method of moving the pivot-point 44 toward the forward end of the steered vessel 10. In FIG. 16, a long boom 120 extends from the steering vessel 12 to a point above the forward end of the steered vessel 10. A linkage assembly 14 connects the boom 120 to the steered vessel 10. This assembly allows the steered vessel 10 to yaw with respect to the boom 120 and the steering vessel 12. The pivot-point 44 is located at the point of connection between the linkage assembly 14 and the steered vessel 10. The steering vessel 12 "pulls" the steered vessel 10 at the pivot-point 44. When the pivot-point 44 is forward of the center of gravity 70, this arrangement is stable; that is, the steered vessel 10 turns in the same direction as the boom 120 and steering vessel 12. However, if the linkage assembly 14 is connected at the stern of the steered vessel 10, an unstable result occurs because the stern rather than the bow of the steered vessel will turn with the boom 120 and steering vessel 12.

Figure 17:
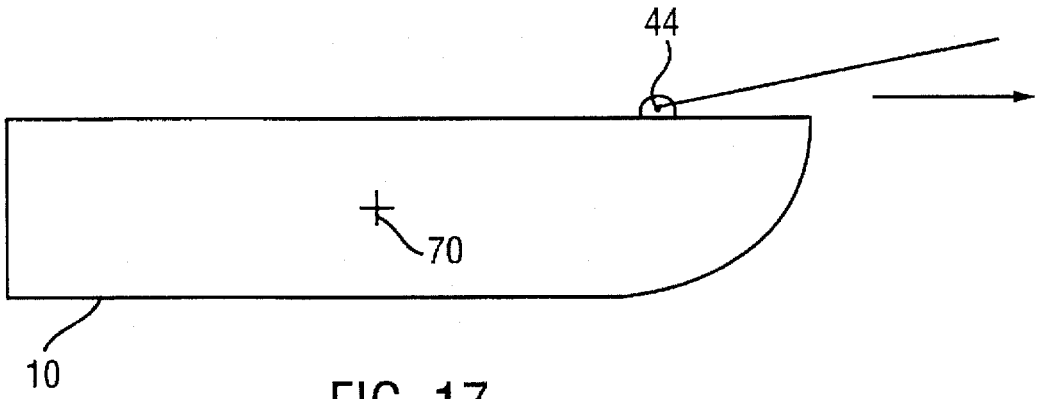
Figure 18:
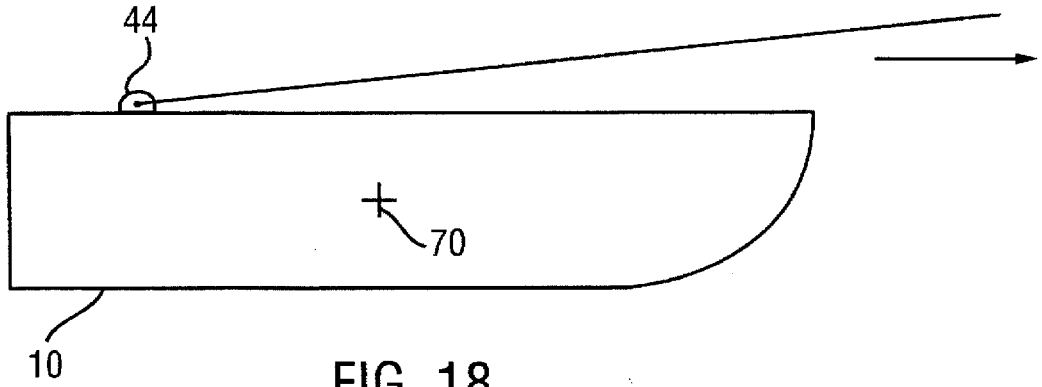
Figure 19:
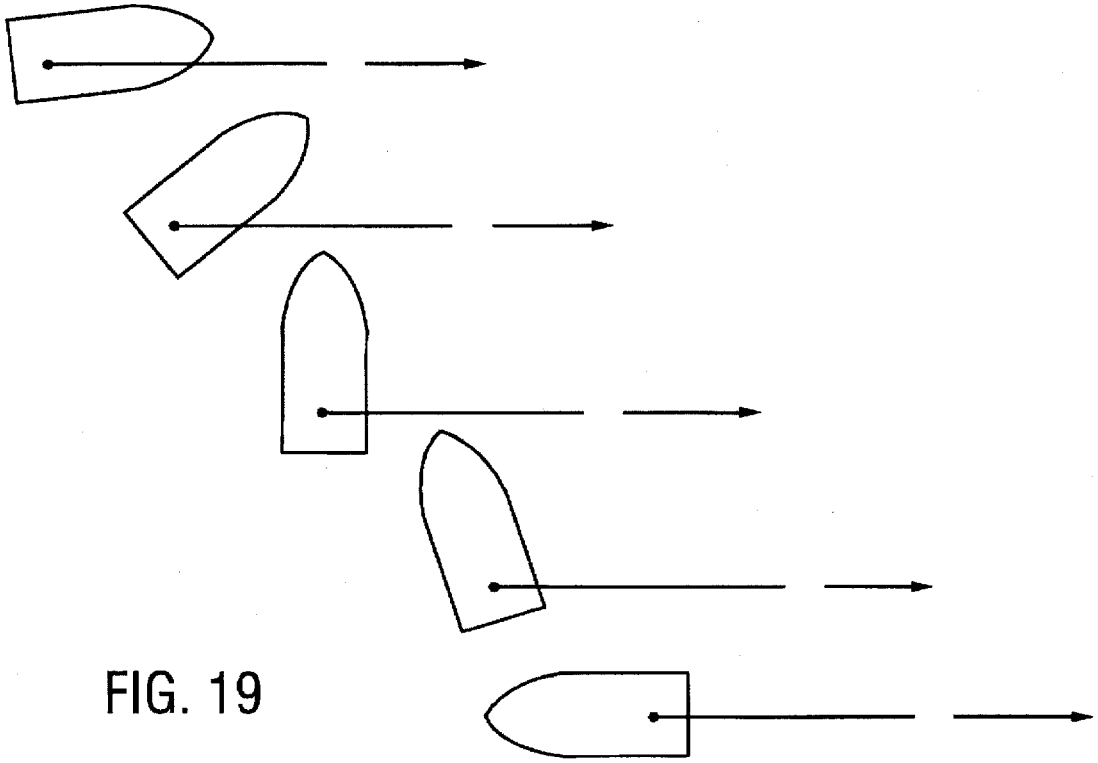

The pivot-point can be viewed as the point from which the leading vessel is pulled by a line which allows the leading vessel to yaw with respect to the trailing vessel. FIG. 17 shows the stable configuration of FIG. 16 wherein the leading vessel (i.e., the steered vessel 10) turns in the direction of the pull. The opposite can occur in FIG. 18 because the stern of the leading vessel (i.e., steered vessel 10) follows the pull. Such a configuration tends to rotate the leading vessel until it reverses direction, as shown in FIG. 19.

Figure 20A:
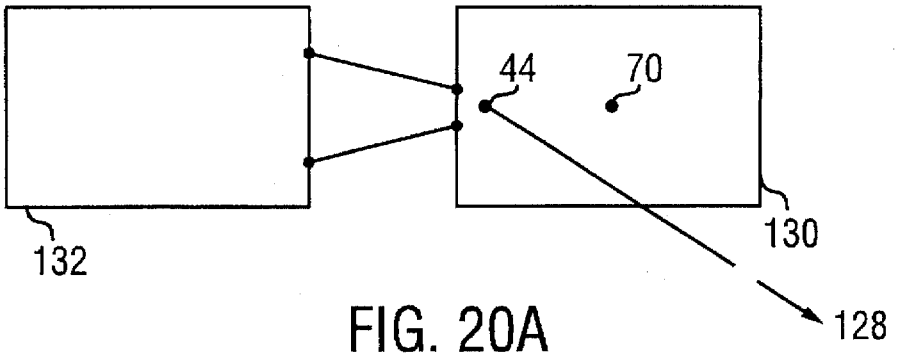
Figure 20B:
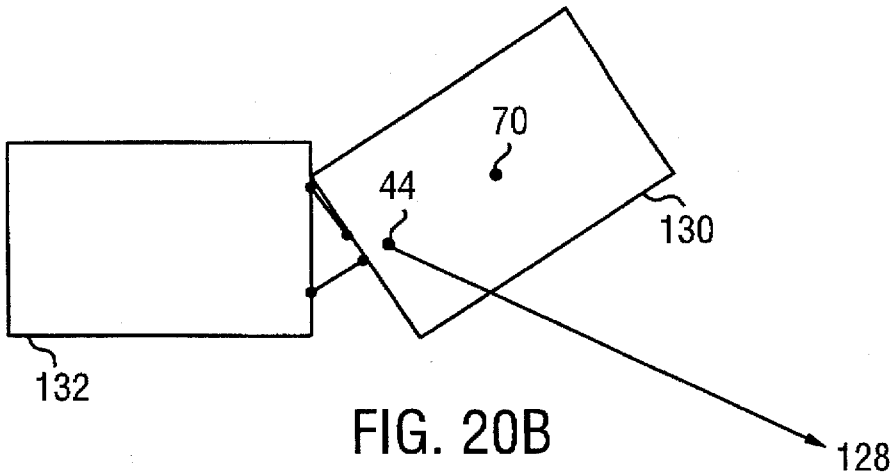

FIG. 20A and FIG. 20 B demonstrate the danger presented by locating the pivot-point 44 aft of the center of gravity 70 of the leading vessel 130 where two nonsteerable vessels are connected. When a yawing force 128 is exerted on the leading vessel 130, that vessel begins to rotate with respect to the trailing vessel 132. However, because the leading vessel 130 is being "pulled" at its stern, the two vessels will tend to "jack-knife" as shown in FIG. 20A and FIG. 20B.

Figure 21A:
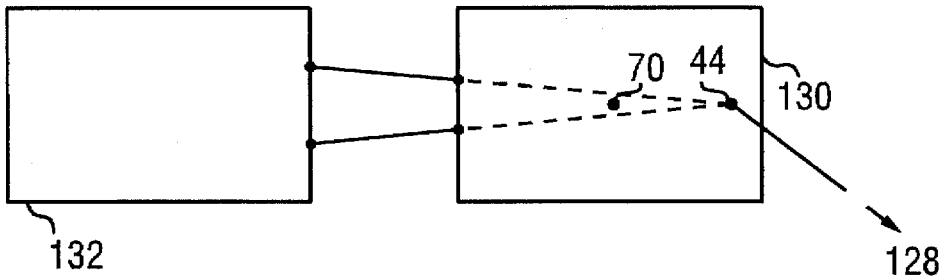
Figure 21B:
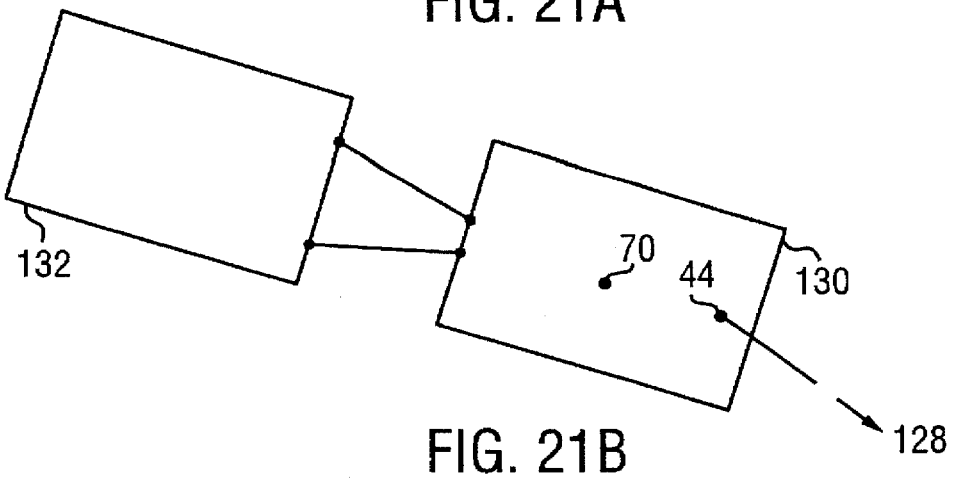

A stable multi-barge connection is shown in FIG. 21A and 21B. The pivot-point 44 is located forward of the leading vessel's center of gravity 70 so that the leading vessel 130 is being "pulled" from its bow by the yawing force 128. In this configuration, the two nonsteerable vessels remain aligned, thereby avoiding a catastrophic "jack-knifing" situation.

Figure 22A:
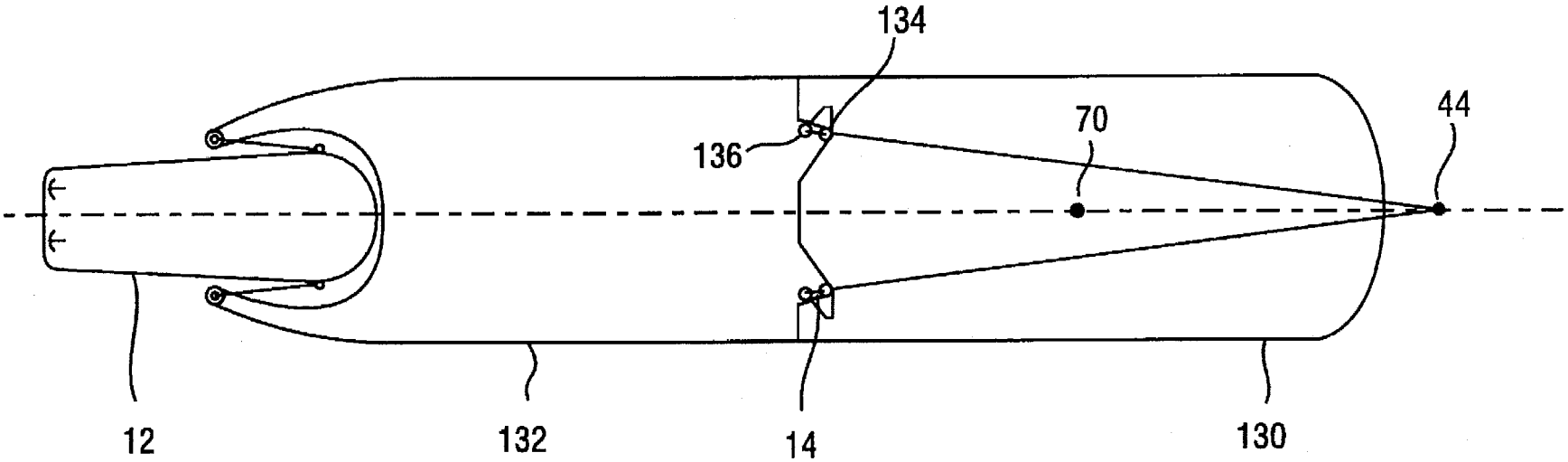
Figure 22B:
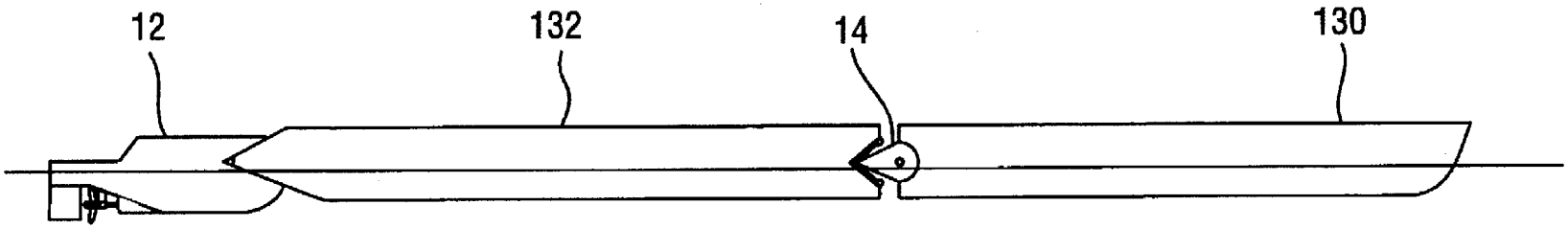

FIG. 22A and FIG. 22B shows a practical application of these principles. In this embodiment, a linkage assembly 14 is used to connect two nonsteerable vessels together such that they may yaw with respect to each other. The linkage assembly 14 is configured so that the pivot-point 44 is well forward of the leading vessel's center of gravity 70. When the steering vessel 12 turns the trailing vessel 132, the leading vessel 130 will be "pulled" in the same direction at the pivot-point 44. By positioning the pivot-point 44 as shown in FIG. 22A and FIG. 22B, the leading vessel 130 will turn with the trailing vessel 132. In this way, a single steering vessel 12 can safely control a large number of connected nonsteerable vessels. The nonsteerable vessels can employ a linkage assembly 14 which allows relative yaw, thus minimizing or eliminating the lateral bending moment of traditional connections.

The linkage assemblies 14 of FIG. 22A and FIG. 22B may be in tension or compression. As shown in FIG. 22A and FIG. 22B, the assemblies 14 are in tension; that is, the trailing vessel linkage assembly pivot joint 134 is located forward of the leading vessel linkage assembly pivot joint 136. If this positioning were reversed, the linkage assemblies 14 would be in compression. The type of force, tension or compression, depends on design characteristics of the leading and trailing vessels. The present invention may employ either configuration.

FIG. 23 shows lateral movement between two vessels, which may be either a steering vessel and steered vessel (e.g., a tug and barge) or two steered vessels (e.g., two barges). This lateral movement is in response to an environmental disturbance 150, which could be caused by a wave or by the wake of a passing vessel. By allowing lateral movement between the two vessels, as shown in FIG. 23 (see also FIGS. 7, 10, and 15, above), the lateral bending moment is greatly reduced. This allows the present invention to utilize smaller and lighter connection components, resulting in a cost savings over alternative connection devices.

Figure 24:
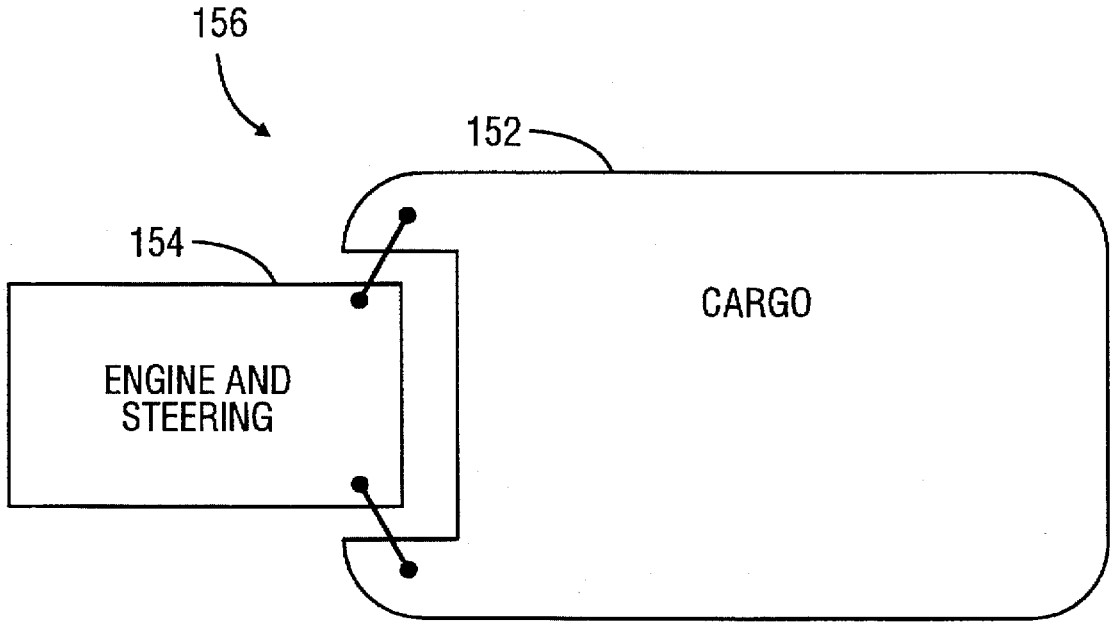

FIG. 24 shows a forward sub-vessel 152 and an aft sub-vessel 154, which together comprise a single composite vessel 156. In FIG. 24, the engine room and steering equipment are located in the aft sub-vessel 154, while the cargo loading sections are located in the forward sub-vessel 152. This configuration improves maneuverability and reduces the lateral bending moment as compared to conventional ships.

These illustrations demonstrate an important principle of the present invention: the pivot-point must be located aft of the leading vessel's center of gravity if the trailing vessel is to maintain a yaw angle with respect to the leading vessel. This result is desired at the steering vessel to steered vessel connection point. In that situation, locating the pivot-point too far forward, as in FIG. 15, makes it quite difficult to maintain a yaw angle on the steering vessel, thereby making it difficult to utilize the improved maneuverability offered by this invention. On the other hand, when two nonsteerable vessels are connected using the present invention, the pivot-point should be forward of the leading vessel's center of gravity to prevent "jack-knifing." The same or similar mechanical devices may be used in both situations, but the devices must be positioned differently.

Further modifications and alternative embodiments of this invention will be apparent to those skilled in the art in view of this description. Accordingly, this description is to be construed as illustrative only and is for the purpose of teaching those skilled in the art the manner of carrying out the invention. It is to be understood that the forms of the invention herein shown and described are to be taken as the presently preferred embodiments. Various changes may be made in the shape, size, and arrangement of parts. For example, equivalent elements or materials may be substituted for those illustrated and described herein, and certain features of the invention may be utilized independently of the use of other features, all as would be apparent to one skilled in the art after having the benefit of this description of the invention.

I claim:

1. Marine transport apparatus, comprising:

a first vessel having a bow, a stern, and port and starboard sides;

a second vessel which follows and pushes the first vessel during normal operations, the second vessel having a bow, a stern, and port and starboard sides;

a port linkage arm having a first end, a second end, and an axis, the first end of the port linkage arm being pivotally connected to the port side of the first vessel's stern, the second end of the port linkage arm being pivotally connected to the port side of the second vessel's bow;

a starboard linkage arm having a first end, a second end, and an axis, the first end of the starboard linkage arm being pivotally connected to the starboard side of the first vessel's stern, the second end of the starboard linkage arm being pivotally connected to the starboard side of the second vessel's bow; and, a pivot point defined by a point of intersection of lines extending along the axes of the port and starboard linkage arms, the pivot point being positioned such that no external force is required to eliminate an undesired yaw angle between the first and second vessel when the vessels are underway.

2. The apparatus of claim 1, wherein the port and starboard linkage arms are in tension when the vessels are underway.

3. The apparatus of claim 1, wherein the first ends of the port and starboard linkage arms are positioned aft of the second ends of the port and starboard linkage arms.

4. The apparatus of claim 1, wherein the second vessel is a tugboat.

5. The apparatus of claim 1, wherein the first and second vessels are sub-vessels that together comprise a single vessel with enhanced lateral flexibility.

6. The apparatus of claim 1, wherein the linkage arms are nonrigid.

7. The apparatus of claim 1, wherein the first and second vessels are nonsteerable vessels.

8. The apparatus of claim 1, wherein the first and second vessels are barges.

9. Marine transport apparatus comprising:

a first steered vessel having a bow, a stern and a centerline;

a steering vessel having a bow, a stern and a centerline;

coupling means coupling the bow of the steering vessel and the stern of the first steered vessel to form a combined center of gravity located in the first steered vessel;

said coupling means including a first linkage arm pivotally connected at opposite ends to the port sides of the steering vessel and said first steered vessel, respectively, and a second linkage arm pivotally connected at opposite ends to the starboard sides of the two vessels, respectively, such that the axes of the two linkage arms intersect along the centerline of the first steered vessel and the steering vessel when the two vessels are in centerline alignment.

10. The apparatus of claim 9, wherein the axes of the two linkage arms intersect aft of the combined center of gravity.

11. The apparatus of claim 9, which further comprises a pivot joint at each pivotal connection.

12. The apparatus of claim 11, wherein at least one of the pivot joints interconnecting the linkage arms and the steering vessel is movable along the steering vessel.

13. The apparatus of claim 12, wherein the first linkage arm and the second linkage arm are configured to simultaneously rotate in the same direction.

14. The apparatus of claim 11, wherein at least one of the pivot joints interconnecting the linkage arms and the steering vessel is removable.

15. The apparatus of claim 11, wherein the pivot joints connected to the steering vessel are forward of the pivot joints connected to the steered vessel.

16. The apparatus of claim 9, wherein the steering vessel is laterally movable relative to the steered vessel.

17. Marine transport apparatus, comprising:

a first vessel having a bow, a stern, and port and starboard sides;

a second vessel having a bow, a stern, and port and starboard sides;

a port linkage arm having a first end, a second end, and an axis, the first end of the port linkage arm being pivotally connected to the port side of the first vessel's stern, the second end of the port linkage arm being pivotally connected to the port side of the second vessel's bow;

a starboard linkage arm having a first end, a second end, and an axis, the first end of the starboard linkage arm being pivotally connected to the starboard side of the first vessel's stern, the second end of the starboard linkage arm being pivotally connected to the starboard side of the second vessel's bow; and, a pivot point defined by a point of intersection of lines extending along the axes of the port and starboard linkage arms, the pivot point being positioned between the second vessel's bow and stern.

18. The apparatus of claim 17, wherein the starboard linkage arm is separate from the port linkage arm.

19. The apparatus of claim 17, wherein the pivot point is positioned such that rudder action alone is sufficient to maintain a desired yaw angle between the first and second vessel when the vessels are underway.

20. The apparatus of claim 17, further comprising a fixed coupling between the first vessel and the second vessel, the fixed coupling being operable to restrain the second vessel from yawing with respect to the first vessel.

21. The apparatus of claim 17, further comprising a port fairing flap and a starboard fairing flap, configured to partially enclose the bow of the second vessel.

22. The apparatus of claim 21, wherein the port fairing flap and the port linkage arm are a unitary structure and the starboard fairing flap and the starboard linkage arm are a unitary structure.

23. The apparatus of claim 17, further comprising a means for selectively yawing the second vessel with respect to the first vessel.

24. The apparatus of claim 17, wherein the second end of the port linkage arm is positionable at different points along the port side of the second vessel's bow and the second end of the starboard linkage arm is positionable at different points along the starboard side of the second vessel's bow, thus altering the positioning of the pivot point.

25. The apparatus of claim 17, wherein the second end of each linkage arms is selectively disconnectable from the bow of the second vessel.

26. The apparatus of claim 17, wherein the linkage arms further comprise relatively lightweight components.

27. A marine transport apparatus, comprising:

a first vessel having a bow and a stern;

a second vessel which follows and pushes the first vessel during normal operations, the second vessel having a bow and a stern;

at least two linkage arms being pivotally connected to the first vessel's stern and the second vessel's bow, the linkage arms configured to allow the first and second vessels to move laterally in the yaw plane with respect to each other.

28. Marine transport apparatus comprising:

a steering vessel having a bow, stern, centerline and center of gravity;

one or more steered vessels, each said steered vessel having a bow, stern, centerline and center of gravity and defining a linear array with said steering vessel with the stern of a first said steered vessel proximate the bow of the steering vessel and each additional steered vessel leading the first said steered vessel and having its stern proximate the bow of its next trailing steered vessel and its bow proximate the stern of its next leading steered vessel;

separate coupling means coupling the bow of each said steered vessel with the stern of the next leading steered vessel, each said coupling means comprising a first linkage arm of a pair of linkage arms pivotally connected at its opposite ends to the port sides of its respective two vessels and a second linkage arm of said pair pivotally connected at its opposite ends to the starboard sides of said its respective two steered vessels, each said pair of said first and second linkage arms defining longitudinal axes which intersect along the centerline of said linear array when the steered vessels are in centerline alignment to define a pivot point forward of the center of gravity of the leading steered vessel of the two said respective steered vessels.

29. The apparatus of claim 28, further comprising a steering coupling means coupling the steering vessel to an aft steered vessel, said coupling means comprising a first linkage arm of a pair of linkage arms pivotally connected at its opposite ends to the port sides of the steering vessel and the aft steered vessel and a second linkage arm of said pair pivotally connected at its opposite ends to the starboard sides of the steering vessel and the aft steered vessel, each said pair of said first and second linkage arms defining longitudinal axes which intersect aft of the bow of the steering vessel.

30. The apparatus of claim 29, wherein the longitudinal axes of the linkage arms intersect between the bow and stern of the steering vessel.

31. The apparatus of claim 28, wherein there are at least two steered vessels, said steered vessels forming pairs, and the longitudinal axes of the linkage arms interconnecting each pair of steered vessels intersect forward of the center of gravity of the leading steered vessel of each pair.

32. A method for enhancing the lateral flexibility of oceangoing tug and barge flotillas, comprising pivotally connecting a tug to a first barge such that rudder action alone is sufficient to maintain a yaw angle between the tug and the first barge when the flotilla is underway.

33. The method of claim 32, further comprising preventing a jackknifing situation from occurring between the tug and the first barge.

34. The method of claim 32, further comprising pivotally connecting a second barge to the first barge such that the barges may yaw with respect to each other, and preventing jackknifing between the barges without applying external force.

35. A method for enhancing the lateral flexibility of connected nonsteerable vessels, comprising: pivotally connecting a first nonsteerable vessel to a second nonsteerable vessel such that the first and second nonsteerable vessels can yaw with respect to each other; preventing jackknifing between the first and second nonsteerable vessels; and eliminating undesirable yaw angles between the first and second nonsteerable vessels without the use of external force.

* * * * *